US009206020B2

(12) United States Patent
Waisanen et al.

(10) Patent No.: US 9,206,020 B2
(45) Date of Patent: Dec. 8, 2015

(54) WORK PLATFORM FOR AN OVERHEAD CRANE

(71) Applicants: Steve K. Waisanen, Big Bend, WI (US); Fred J. D'Amico, Brookfield, WI (US); Neal Charles Erikson, Franklin, WI (US); Henry Jacob Conrady, III, Menomonee Falls, WI (US)

(72) Inventors: Steve K. Waisanen, Big Bend, WI (US); Fred J. D'Amico, Brookfield, WI (US); Neal Charles Erikson, Franklin, WI (US); Henry Jacob Conrady, III, Menomonee Falls, WI (US)

(73) Assignee: MHE Technologies, Inc., Wilmington, DE (US)

( * ) Notice: Subject to any disclaimer, the term of this patent is extended or adjusted under 35 U.S.C. 154(b) by 0 days.

(21) Appl. No.: 13/719,338

(22) Filed: Dec. 19, 2012

(65) Prior Publication Data

US 2013/0117999 A1 May 16, 2013

Related U.S. Application Data

(60) Division of application No. 11/075,078, filed on Mar. 8, 2005, now Pat. No. 8,360,203, which is a continuation-in-part of application No. PCT/US2004/028753, filed on Sep. 3, 2004, and a continuation-in-part of application No. PCT/US03/27887, filed on Sep. 5, 2003.

(51) Int. Cl.

| | |
|---|---|
| ***B66C 17/00*** | (2006.01) |
| ***B66C 17/06*** | (2006.01) |
| ***B66F 11/04*** | (2006.01) |

(52) U.S. Cl.

CPC ..... *B66C 17/06* (2013.01); *B66C 17/00* (2013.01); *B66F 11/04* (2013.01); *Y10T 29/49* (2015.01)

(58) Field of Classification Search

CPC ..... E04G 3/22; E04G 3/28; E04G 2003/286; E01D 19/106; B62D 57/00; B66F 11/04; B60P 1/6445; B66C 17/00; B66C 17/06

USPC ..... 182/69.4, 69.6, 141; 212/74, 270, 328, 212/329, 336, 343; 414/146

See application file for complete search history.

(56) References Cited

U.S. PATENT DOCUMENTS

| | | | |
|---|---|---|---|
| 780,711 | A | 1/1905 | Donnell |
| 1,095,391 | A | 5/1914 | Fogle |
| 1,373,464 | A | 4/1921 | Titcomb |
| 2,107,210 | A | 2/1938 | Palm |

(Continued)

FOREIGN PATENT DOCUMENTS

| | | |
|---|---|---|
| DE | 92 14 587.6 | 2/1993 |
| DE | 20201897 | 6/2003 |

(Continued)

*Primary Examiner* — Colleen M Chavchavadze

(74) *Attorney, Agent, or Firm* — Porter, Wright, Morris & Arthur, LLP

(57) ABSTRACT

A work platform for use in performing maintenance while supported on an overhead crane. The work platform is particularly useful for performing maintenance on an overhead cranes located in areas where normal lifting equipment and/or scaffolding cannot easily access the overhead crane. However, the work platform is also useful for performing maintenance on equipment and/or structures in the vicinity of overhead cranes, and on overhead cranes located in areas without accessibility problems. The work platform is hoisted for placement on the support structure of the overhead crane by hoist apparatus of the overhead crane. When positioned, the work platform may be fully supported on the support structure of the overhead crane.

5 Claims, 11 Drawing Sheets

(56) References Cited

U.S. PATENT DOCUMENTS

| | | | | | |
|---|---|---|---|---|---|
| 2,644,593 | A | | 7/1953 | Miller | |
| 2,936,907 | A | | 5/1960 | Woodruff | |
| 3,152,709 | A | * | 10/1964 | Fowler | 296/35.3 |
| 3,541,598 | A | * | 11/1970 | Dousset | 414/459 |
| 3,572,513 | A | * | 3/1971 | Tantlinger et al. | 212/180 |
| 3,784,035 | A | * | 1/1974 | Dunbar | 414/543 |
| 3,811,579 | A | * | 5/1974 | Black | 414/347 |
| 3,855,747 | A | | 12/1974 | Langan | |
| 3,945,503 | A | | 3/1976 | Cooper | |
| 3,960,242 | A | | 6/1976 | Saxonmeyer | |
| 3,961,712 | A | | 6/1976 | Bartley | |
| 4,522,550 | A | * | 6/1985 | Whitehouse | 414/498 |
| 4,660,678 | A | * | 4/1987 | Krag | 182/14 |
| 4,676,339 | A | | 6/1987 | Rybka et al. | |
| 4,705,140 | A | | 11/1987 | Dusdley et al. | |
| 4,919,234 | A | * | 4/1990 | Pearson et al. | 187/213 |
| 5,301,770 | A | | 4/1994 | Regan et al. | |
| 5,394,956 | A | | 3/1995 | Hulse | |
| 5,417,540 | A | * | 5/1995 | Cox | 414/495 |
| 5,649,636 | A | * | 7/1997 | Baumann | 212/344 |
| 5,706,736 | A | | 1/1998 | Thorsen | |
| 5,810,183 | A | * | 9/1998 | Feider et al. | 212/291 |
| 6,071,062 | A | * | 6/2000 | Warhurst et al. | 414/498 |
| 6,138,846 | A | | 10/2000 | Baumann | |
| 6,155,770 | A | * | 12/2000 | Warhurst | 414/498 |
| 6,523,647 | B2 | | 2/2003 | Duplessis | |
| 7,744,333 | B2 | * | 6/2010 | Chaddock | 414/542 |
| 7,811,044 | B2 | * | 10/2010 | Warhurst | 414/458 |

FOREIGN PATENT DOCUMENTS

| | | | | |
|---|---|---|---|---|
| EP | 0949184 | | 10/1999 | |
| GB | 2028248 | | 3/1980 | |
| SU | 532684 | | 8/1975 | |
| WO | WO 86/02121 | * | 4/1986 | 182/14 |
| WO | WO 92/19527 | | 11/1992 | |
| WO | WO 01/07289 | | 2/2001 | |

* cited by examiner

WORK PLATFORM FOR AN OVERHEAD CRANE

CROSS-REFERENCE TO RELATED APPLICATIONS

This application is a divisional of U.S. patent application Ser. No. 11/075,078 filed on Mar. 8, 2005, which is a continuation-in-part of PCT Application Number PCT/US04/28753 filed on Sep. 3, 2004 and PCT Application Number PCT/US03/27887 filed on Sep. 5, 2003, the disclosures of which are expressly incorporated herein in their entireties by reference.

FIELD OF THE INVENTION

The invention relates to overhead cranes, and more particularly, to the performance of maintenance on overhead cranes.

BACKGROUND OF THE INVENTION

It is often necessary to erect scaffolding and/or utilize lifting equipment when performing maintenance (e.g., repair, inspection, cleaning, modernization, and the like) on overhead cranes, and equipment and/or structures in the vicinity of overhead cranes. Erection of scaffolding and/or placement of lifting equipment can be time consuming and dangerous for maintenance personnel. This is especially prevalent in areas with limited access, such as containment buildings for atomic reactor power generating plants.

SUMMARY OF THE INVENTION

The invention provides work platforms for use in performing maintenance while supported on an overhead crane. The work platforms are particularly useful for performing maintenance on cranes located in areas where normal lifting equipment and/or scaffolding cannot easily access the crane. However, work platforms according to the invention are also useful for performing maintenance on equipment and/or structures in the vicinity of overhead cranes, and on overhead cranes located in areas without accessibility problems.

The work platform is hoisted for placement on the support structure of the overhead crane by at least one hoist apparatus of the overhead crane. When positioned, the work platform may be fully supported on the support structure of the overhead crane so the work platform can be utilized to perform an array of tasks, including, among others, the replacement or repair of portions of the overhead crane's hoist apparatus.

In one embodiment, the invention provides an overhead crane apparatus including an overhead crane and a work platform. The overhead crane includes a hoist apparatus operable to raise and lower a load, and a support structure that supports the hoist apparatus above the ground. The work platform is usable to perform maintenance while supported on the support structure. The work platform is capable of being lifted above the ground by the hoist apparatus. The work platform has a work surface sized to support at least one maintenance personnel for the performance of maintenance, and at least one support member that is connectable to the support structure when the work platform is supported by the hoist apparatus. The at least one support member is capable of supporting the work platform on the support structure independent of the hoist apparatus.

In another embodiment, the invention provides a method of performing maintenance while supported on an overhead crane. The overhead crane includes a hoist apparatus operable to raise and lower a load, and a support structure that supports the hoist apparatus above the ground. The method includes providing a work platform, lifting the work platform above the ground using the hoist apparatus, and connecting the work platform to the support structure when the work platform is supported by the hoist apparatus, such that the support structure supports the work platform above the ground for performance of maintenance. The work platform has a work surface sized to support at least one maintenance personnel for the purpose of the performance of maintenance. The work platform is capable of being supported on the support structure independent of the hoist apparatus.

In yet another embodiment, the invention provides a method of performing maintenance while supported on a polar reactor overhead crane positioned in a containment building. The containment building includes an equipment hatch for moving equipment in to and out of the containment building. The polar reactor overhead crane includes a hoist apparatus operable to raise and lower a load, and a support structure that supports the hoist apparatus above the ground. The support structure includes a pair of spaced apart, generally parallel girders, and a generally circular rail that supports the girders. The method includes providing a work platform, moving the work platform through the equipment hatch and into the containment building, lifting the work platform above the ground using the hoist apparatus, and connecting the work platform to the girders when the work platform is supported by the hoist apparatus, such that the support structure supports the work platform above the ground for the performance of maintenance. The work platform has a work surface sized to support at least one maintenance personnel for the performance of maintenance. The work platform is capable of being supported on the support structure independent of the hoist apparatus.

In still another embodiment, the invention provides a work platform for a crane having a hoist supported by a girder. The work platform includes a substantially horizontal base sized to support at least one person, and a suspension support. The suspension support is coupled to the base and removably engageable with the girder to temporarily couple the base to the girder. A coupling is attached to the base to which the hoist is connectable to allow the hoist to raise and lower the platform to and from a position wherein the suspension support can engage the girder.

In yet another embodiment, the invention provides a jib crane comprising a mast, a first boom, and a second boom. The first boom is pivotally coupled to an end of the mast and includes a first hoist movable on the first boom. The second boom is movably coupled to the first boom and includes a second hoist movable on the second boom.

In yet another embodiment, the invention provides an overhead crane apparatus comprising a hoist apparatus, a support structure, and a work platform. The hoist apparatus is operable to raise and lower a load and the support structure supports the hoist apparatus above the ground. The work platform is usable to perform maintenance while supported on the support structure and is capable of being lifted above the ground by the hoist apparatus. The work platform further includes at least one support member capable of supporting the work platform on the support structure independent of the hoist apparatus. The support member is movable along the support structure such that the work platform moves along the support structure.

In still another embodiment, the invention includes an overhead crane apparatus comprising a hoist apparatus, a support structure, and a work platform. The hoist apparatus is operable to raise and lower a load and the support structure supports the hoist apparatus above the ground. The work platform has a base and is usable to perform maintenance while supported on the support structure. The work platform is capable of being lifted above the ground by the hoist apparatus and includes at least one support member that is connectable to the support structure. The support member is capable of supporting the work platform on the support structure independent of the hoist apparatus. The base of the work platform is movable up and down along the support member.

In another embodiment, the present invention provides a crane apparatus comprising a hoist apparatus, a support structure, and a work platform. The hoist apparatus is operable to raise and lower a load and the support structure comprises at least two girders spaced apart from each other and along which a trolley that supports the hoist apparatus above the ground moves. The work platform has a base and is usable to perform maintenance while supported on the support structure. The work platform is capable of being lifted above the ground by the hoist apparatus and includes at least one support member that is connectable to the girders. The support member is capable of supporting the work platform on the girders independent of the hoist apparatus. The base of the work platform is adjustable to correspond to the distance between the girders.

In yet another embodiment, the invention provides an overhead crane apparatus comprising a hoist apparatus, a support structure, a work platform, and a mast. The hoist apparatus is operable to raise and lower a load and the support structure supports the hoist apparatus above the ground. The work platform has a base and is usable to perform maintenance while supported on the support structure. The work platform is capable of being lifted above the ground by the hoist apparatus and includes at least one support member that is connectable to the support structure. The support member is capable of supporting the work platform on the support structure independent of the hoist apparatus. The mast extends substantially perpendicularly from the base.

In still another embodiment, the invention provides method of implementing a work platform for an overhead crane. The overhead crane includes a support structure that supports a hoist above the ground and the work platform includes a base and a first support member connected to the base and along which the base moves. The method includes moving the work platform on a car into a space serviced by the overhead crane, engaging the first support member with the ground around the car, and moving the base of the work platform along the first support member to lift the work platform off of the car.

Further objects of the present invention together with the organization and manner of operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show an embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and coupled" are sued broadly and encompass both direct and indirect mountings, connections, supports, and couplings. Further, "connected" and "coupled" are not restricted to physical or mechanical connections or couplings.

DETAILED DESCRIPTION OF CERTAIN PREFERRED EMBODIMENTS

Figure 3:
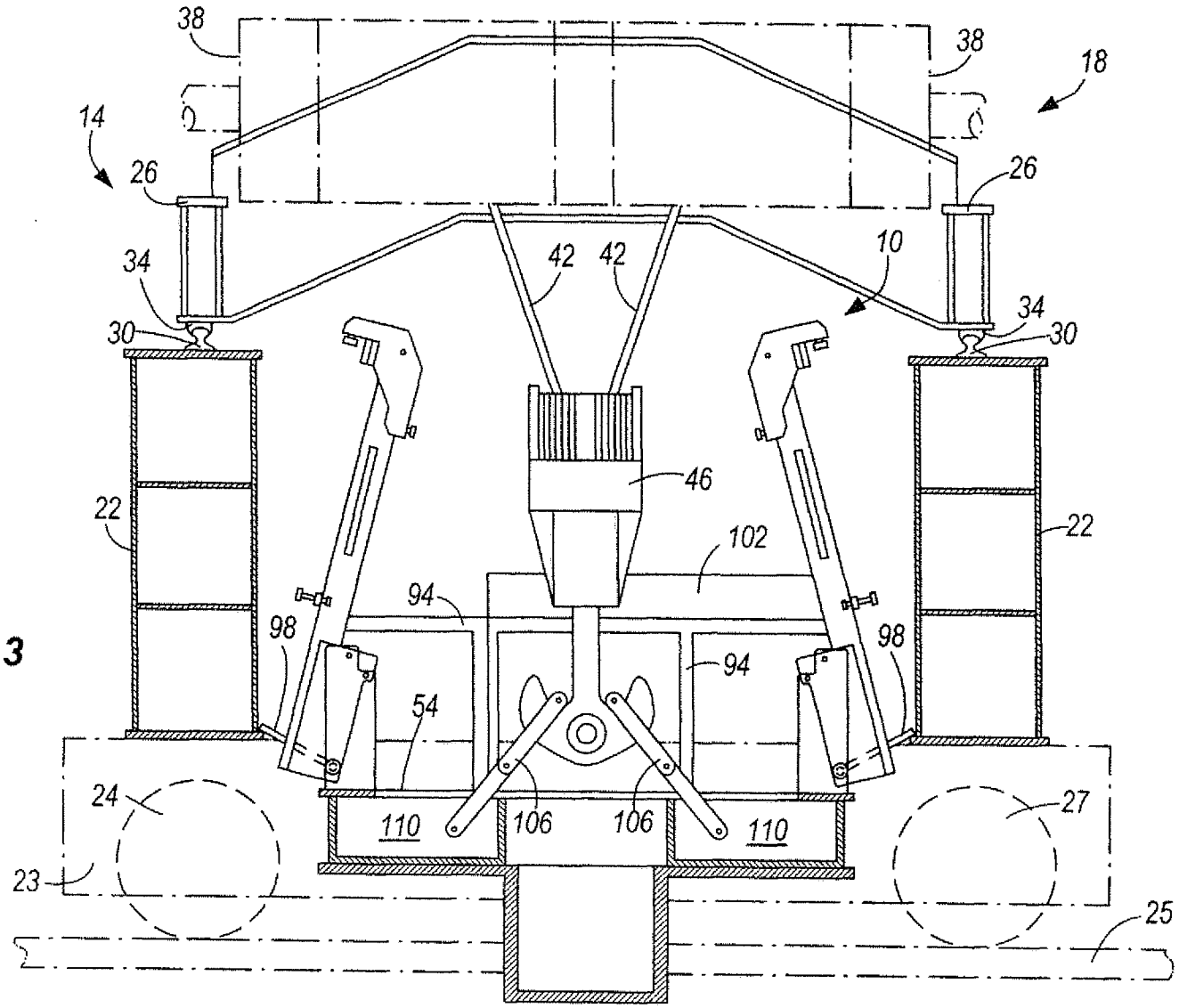
FIG. 3 illustrates a sectional view of the work platform of FIG. 1 showing the work platform positioned in a hoisted position.

The figures illustrate a work platform 10 according to one embodiment of the invention. The work platform 10 is illustrated and described as being utilized to perform maintenance while supported on a polar reactor overhead crane 14 (FIG. 3). A polar reactor overhead crane is disclosed in each of U.S. Pat. Nos. 3,960,242, and 5,706,736. It should be understood that the work platform 10 of the present invention is capable of use in performing maintenance while supported on other overhead cranes, and the overhead crane 14 is merely shown and described as one such example.

Figure 4:
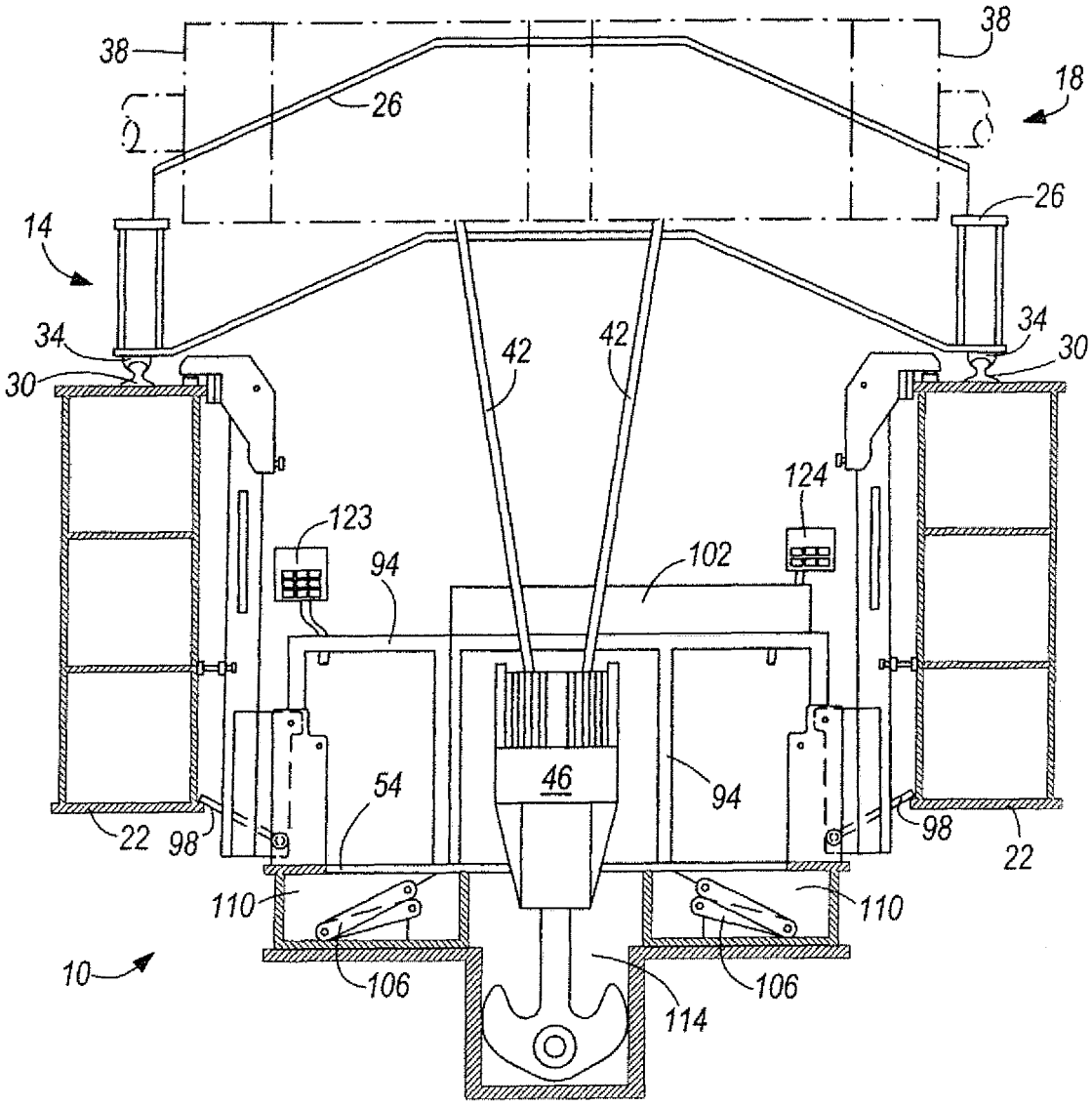
FIG. 4 illustrates a view similar to FIG. 3 showing the work platform positioned in a maintenance performing position.
Figure 5:
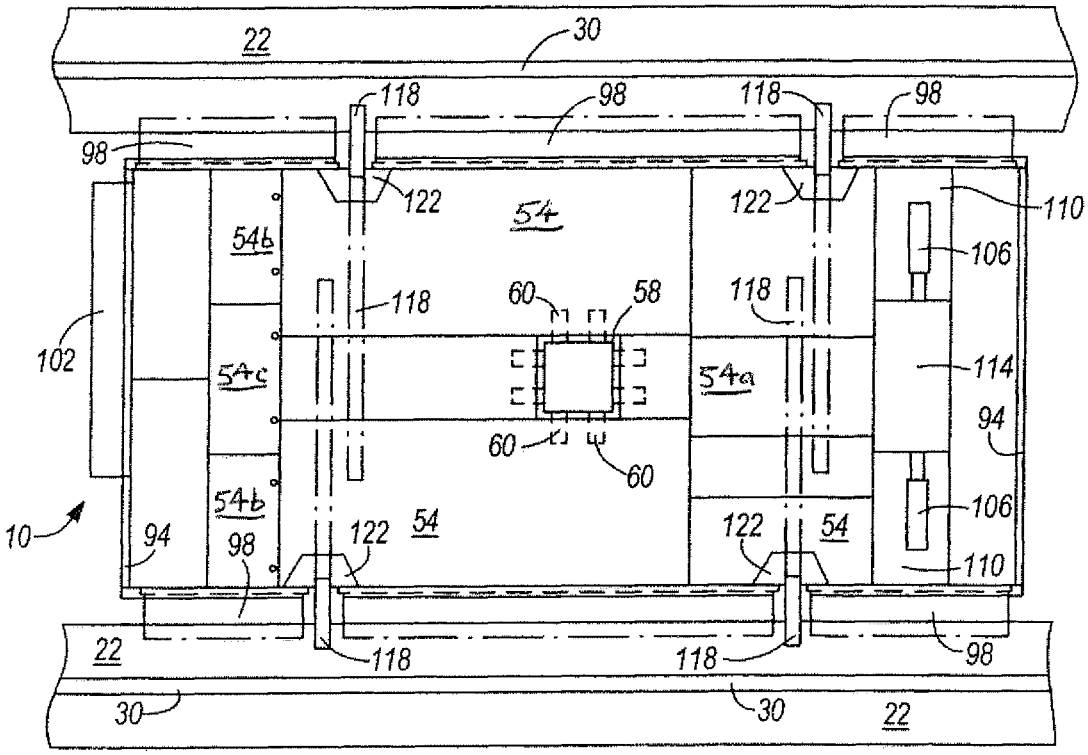
FIG. 5 illustrates a top view of the work platform of FIG. 1 positioned in a maintenance performing position.

The overhead crane 14 includes hoist apparatus 18 (FIG. 8), and a pair of spaced apart, generally parallel girders or bridge cross-members 22 (FIGS. 3-5). With reference to FIG. 3, trucks 23 mounted at opposite ends of the girders 22 include drive wheels 24 rotatably mounted for engagement with circular rail 25. The trucks 23 may also include non-driven or idler wheels 27 rotatably mounted for engagement with the rail 25. The rail 25 is mounted on suitable foundation means. The trucks 23, drive wheels 24, rail 25, and idler wheels 27 are schematically illustrated in FIG. 3 and may be sized differently and/or positioned alternatively with respect to the girders 22 in actual constructions. Engagement of the drive and idler wheels 24 and 27 with the rail 25 supports the crane 14 and permits travel of the crane 14 along the rail 25. Movement of the hoist apparatus 18 relative to the girders 22 in combination with movement of the girders 22 along the rail 25 allows the hoist apparatus 18 to access all areas within the containment building in which the crane 14 is operating. In other embodiments, the hoist apparatus 18 may be fixed relative to the girders 22 and/or the girders 22 may be fixed relative to the rail.

Figure 8:
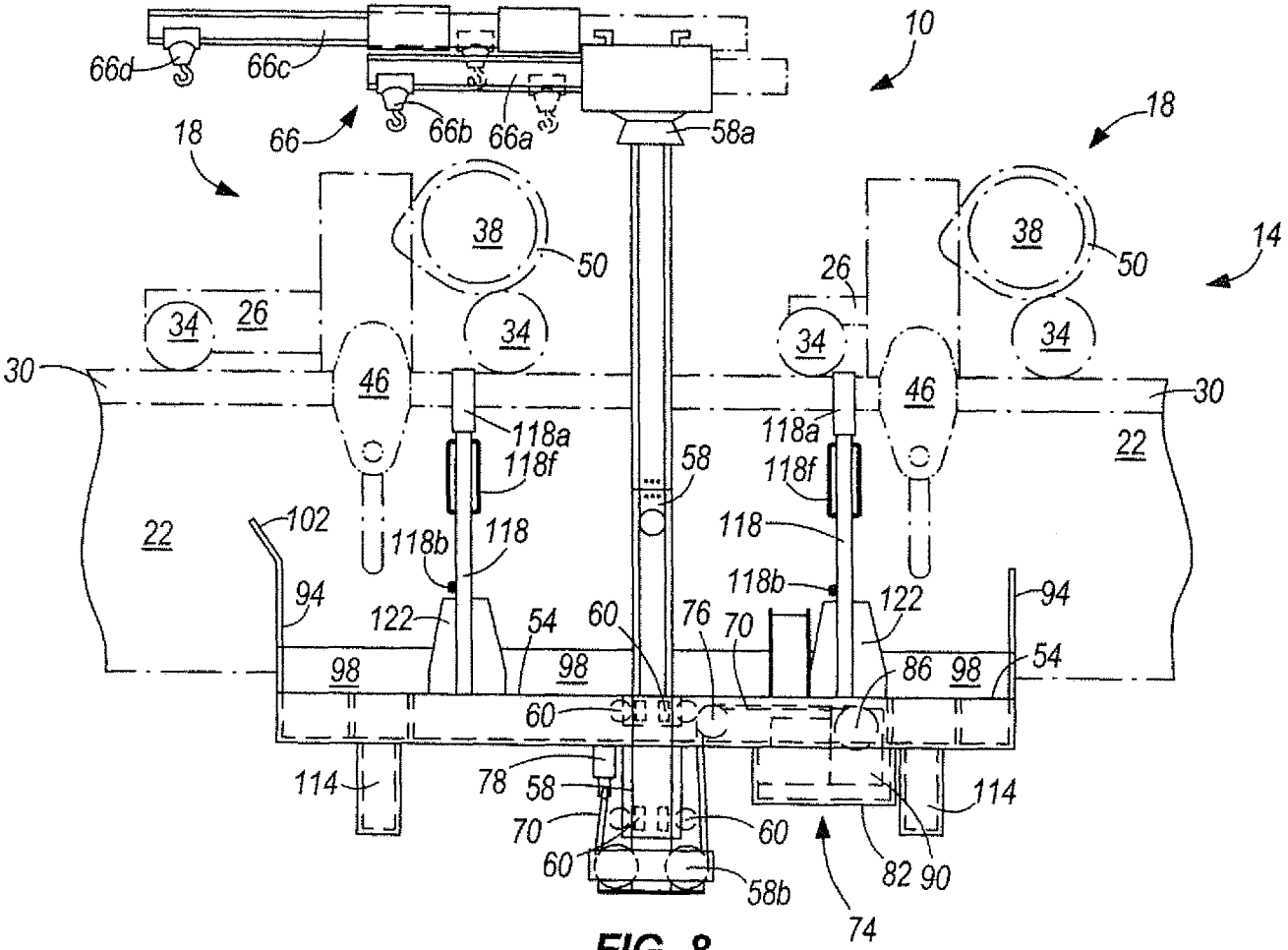
FIG. 8 illustrates a side view of the work platform of FIG. 1 with a jib crane attachment installed.

With reference to FIG. 8, each hoist apparatus 18 is adapted to be supported on the girders 22 for movement relative to the girders 22. More specifically, each hoist apparatus 18 includes a trolley or frame 26 that is supported fro travel on tracks or rails 30 by wheel assemblies 34. The rails 30 are mounted on the girders 22 of the crane 14. The hoist apparatus 18 also includes a hoist drum 38 mounted on the frame 26 for rotation about a drum axis. A hoist rope 42 (FIGS. 3 and 4) is wound around the drum 38 such that the rope 42 winds on to and off of the drum 38 in response to rotation of the drum 38 in opposite wind-on and wind-ff direction, respectively.

The hoist apparatus 18 also includes a load engaging mechanism 46 connected to the rope 42. The load engaging mechanism 46 includes a bottom block through which the rope 42 is reeved, and a hook depending from the bottom of the bottom block. As is known in the art, the load engaging mechanism 46 moves upward when the rope 42 winds on to the drum 38, and moves downward when the rope 42 winds off of the drum 38. The hoist apparatus 18 also includes a motor 50 that is mounted on the frame 26. The motor 50 is connected to the drum 38 for selectively rotating the drum 38 in the opposite wind-on and wind-off directions. The hoist apparatus 18 as thus far described are conventional and need not be described in greater detail. The crane 14 is illustrated as including two host apparatus 18. In other embodiments, the crane 14 may include fewer or more hoist apparatus 18.

The work platform 10 is a structure that is temporarily attached to the girders 22 of the crane 14. The work platform 10 functions as a work area for maintenance personnel that are performing maintenance on the crane 14 and/or on other equipment and/or structure in the vicinity of the crane 14. The work platform 10 also functions as an installation tool in the performance of such maintenance. The work platform 10 is particularly useful for performing maintenance on the crane 14 because it is located in an area (i.e., a containment building) where normal lifting equipment and/or scaffolding cannot easily access the crane 14. In other embodiments, work platforms according to the invention are also useful in performing maintenance in areas without accessibility problems.

The work platform 10 includes a generally horizontal work surface 54 (FIG. 5) sized to support at least one maintenance personnel for performing maintenance. The illustrated work surface 54 is sized to support up to four maintenance personnel. In other constructions, the work surface 54 may be smaller or larger. The illustrated work surface 54 is coated with an anti-skid paint.

With reference to FIG. 5, a mast 58 extends through the center of the work surface 54. Guide rollers 60 allow the mast 58 to move vertically relative to the work surface 54. The illustrated mast 58 is constructed in two portions to ease transport of the work platform 10. The upper portion of the mast 58 (FIG. 8) includes a rotating assembly 58*a*. A number of different attachments are connectable to the mast 58 for use in performing maintenance.

Figure 1:
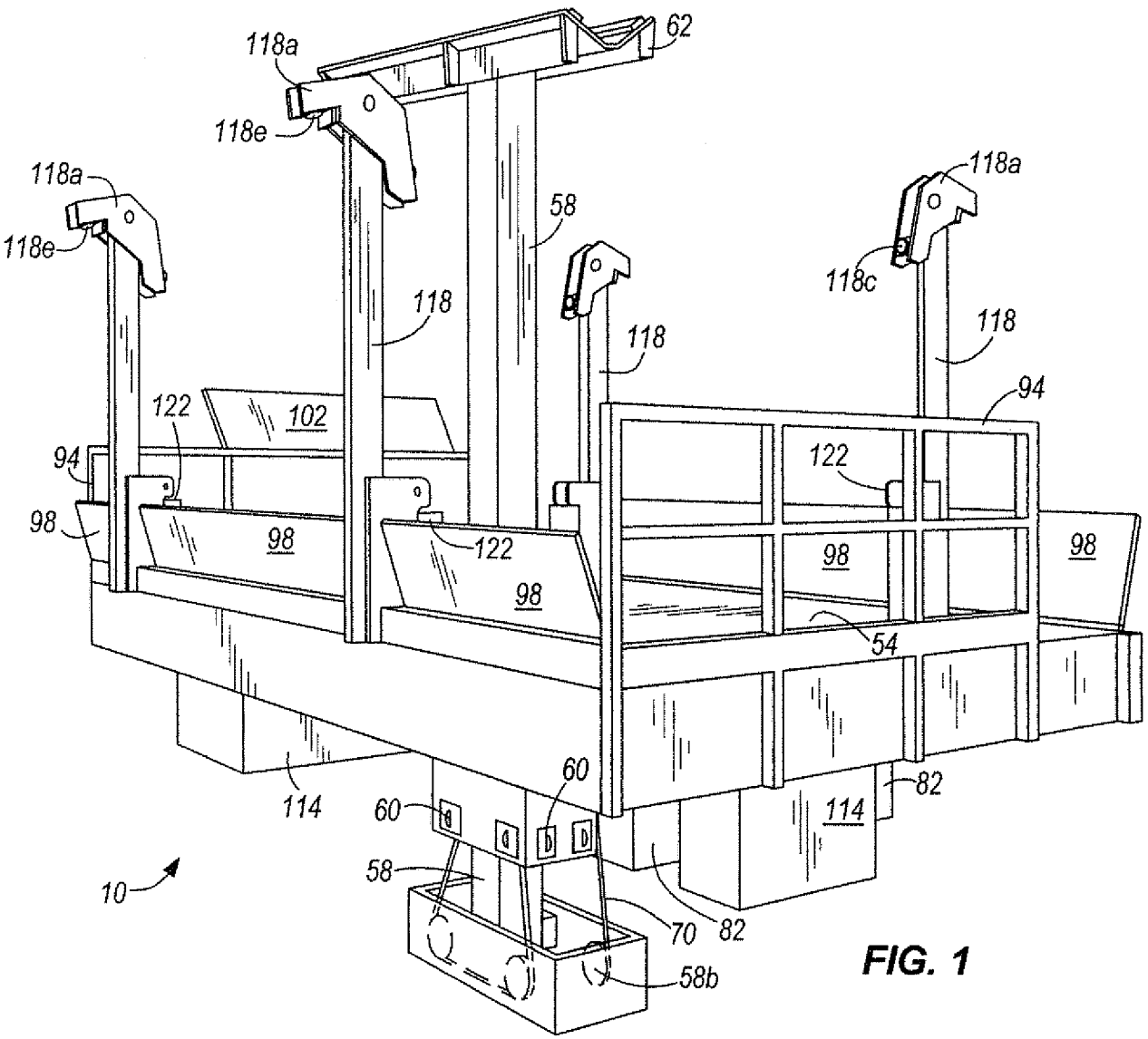
FIG. 1 illustrates a perspective view of a work platform for use in performing maintenance while supported by an overhead crane.
Figure 9:
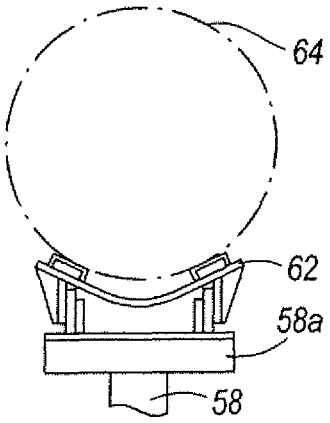
FIG. 9 illustrates a drum cradle attachment that can be installed on the work platform of FIG. 1.

FIGS. 1 and 9 illustrate a drum cradle attachment 62. The drum cradle attachment 62 is sized to handle hoist drum assemblies 64 (e.g., the drum 38, the rope 42 wrapped on the drum 38, gearing of the drum 38, and the like). The drum cradle attachment 62 is fully rotatable when positioned on the rotating assembly 58*a*. In one construction, the rotating assembly 58*a* includes two sets of thrust bearings to provide such rotation. The drum cradle attachment 62 also includes a longitudinal adjustment feature to ease placement of the drum cradle attachment 62 with respect to a hoist drum assembly 64, and to allow movement of the hoist drum assembly 64 relative to the mast 58 when the hoist drum assembly 64 is supported on the drum cradle attachment 62. The drum cradle attachment 62 may be alternatively constructed in other embodiments.

FIG. 8 illustrates a jib crane attachment 66. The jib crane attachment 66 is movable between a locked position, as shown in dotted lines on FIG. 8, and a fully extended position, as shown in solid lines in FIG. 8. The jib crane attachment 66 includes a two-beam design that eases movement of the jib crane attachment 66 relative to the crane 14. The lower beam 66*a* includes a two-ton capacity hook 66*b* mounted on rollers. The upper beam or boom 66*c* includes a one-ton capacity chain hoist 66*d* mounted on rollers. the illustrated jib crane attachment 66 can extend up to approximately eighteen feet from the mast 58. The jib crane attachment 66 may be alternatively constructed in other embodiments and may be connected, permanently or temporarily, to a portion of the overhead crane 14, such as the girders 22 or trolley 26.

In other embodiments, a worker basket attachment that supports movement of maintenance personnel relative to the work surface 54 may be connected to the mast 58. The worker basket attachment may include both vertical and horizontal movement relative to the mast 58. In constructions where the worker basket attachment is utilized to perform maintenance on equipment and/or structure in the vicinity of the crane 14 (e.g., sprayers located on the ceiling of the containment building), the crane 14 may be moved to reposition the worker basket attachment relative to the equipment and/or structure. In yet other embodiments, other types of attachments may be attached to the mast 58 to perform or assist in the performance of maintenance.

With reference to FIGS. 1 and 8, the lower portion of the mast 58 includes a sheave assembly 58*b*. Rope 70 extending from a hoist unit 74 is reeved around redirection sheaves 76, through the sheave assembly 58*b*, and to a dead ended assembly 78 mounted on the underside of the work platform 10. The illustrated dead end assembly 78 includes two dead ends mounted to a load bar. The hoist unit 74 is mounted below the work surface 54 in a hoist unit compartment 82. The hoist unit 74 includes a hoist drum 86 having the rope 70 wound there around in a double reeved configuration such that the rope 70 winds on to and off of the drum 86 in response to rotation of the drum 86 in opposite wind-on and wind-off directions, respectfully. The hoist unit 74 also includes a motor 90 that selectively rotates the drum 86 in the opposite wind-on and wind-off direction. The mast 58 moves upward when the rope 42 winds on to the drum 38, and moves downward when the rope 42 winds off of the drum 38. The illustrated mast 58 provides fourteen feet of vertical travel at ten feet-per-minute, and includes eleven tons of lift capacity.

Figure 10:
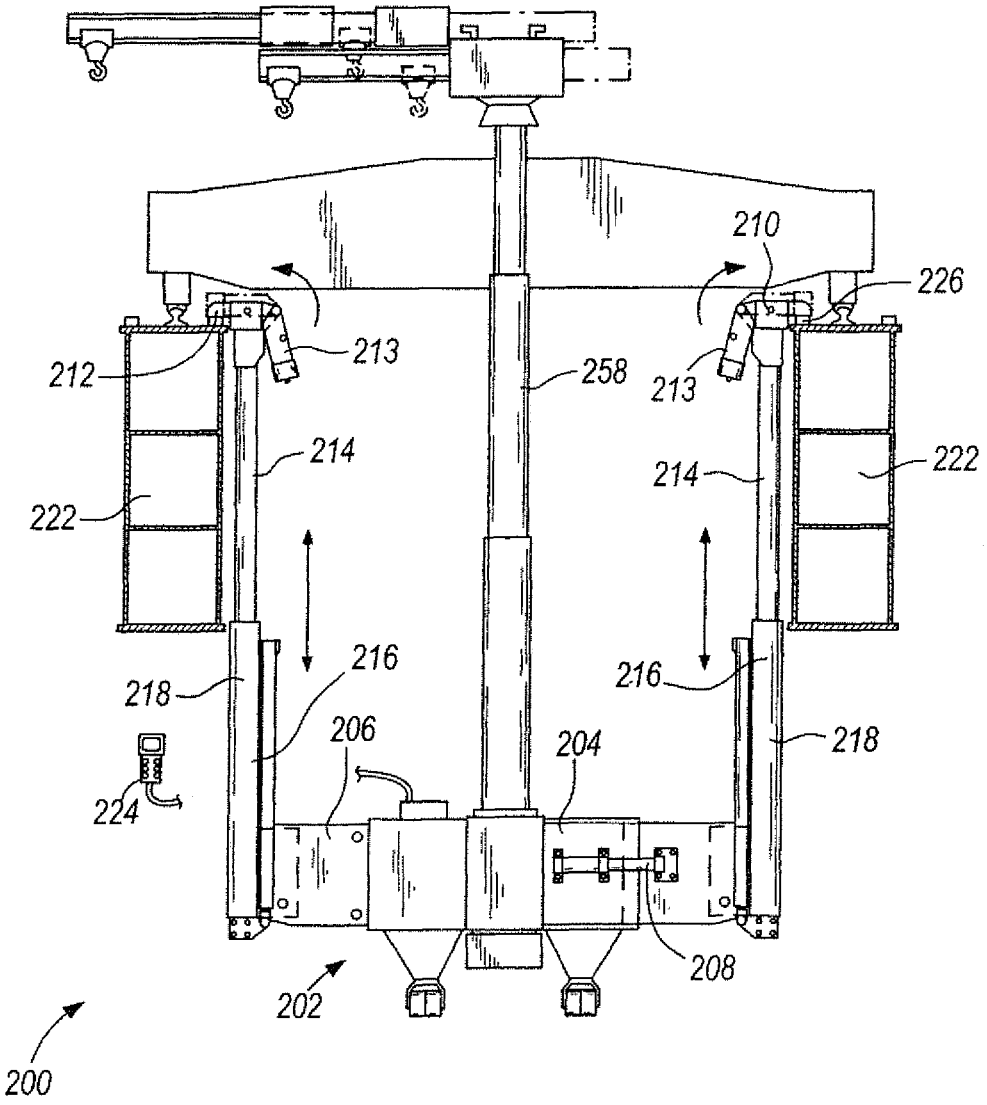
FIG. 10 illustrates another embodiment of a work platform for use in performing maintenance while supported by an overhead crane.

The mast may be alternatively be a telescoping mast 258, as shown in FIG. 10. The telescoping mast 258 includes sections (3, as illustrated in FIG. 10) that nest within one another and hydraulically extend relative to each other to provide extension of the mast without requiring the mast to extend below the base of the work platform, as is the case in the embodiment of the work platform 10, shown in FIGS. 1 through 8. The mast 58 may alternatively be constructed in other embodiments.

With reference to FIG. 1, the work platform 10 is equipped with lift-off handrails 94. The hand rails 94 may include multiple removable segments to allow equipment or other objects to pass. In other embodiments, the handrail 94 may include a chain gate to allow equipment or other objects to pass. Further, the hand rail 94 may include a removable barrier to prevent objects from falling from the work platform 10. In some constructions, the removable-barrier is see-through (e.g., acrylic).

With reference to FIGS. 1 and 3-4, the work platform 10 includes wing plates 98 extending outward from the sides of the work surface 54. A wing plate 102 is also positioned on a portion of the handrail 94. The wing plates 102 prevent objects from falling from the work platform 10. The illustrated wing plates 98 are pivotable, the wing plate 102 is fixed. In other embodiments, the work platform 10 may include fewer or more wing plates 98, 102, or other types of object deflectors.

With reference to FIGS. 3-5, the work platform 10 includes hook linkages 106. Each hook linkage 106 is mounted below the work surface 54 in a hook linkage compartment 110. The hook linkages 106 fold away into respective hook linkage compartments 110 when not in use, and extend from the hook linkage compartments 110 for engagement by the load engaging device 46 of a respective hoist apparatus 18. The work platform 10 includes two sets of hook linkages 106. In other embodiments, the work platform 10 may include fewer or more sets of hook linkages 106, or other types of hook attachments.

The work surface 54 includes a plurality of trap doors 54*a*, 54*b*, 54*c* to compartments (e.g., the hoist unit compartment 82, the hook linkage compartments 110) located below the work surface 54. The compartments are utilized to provide access to equipment (e.g., the hoist unit 74), and to stow equipment, tools and the like. With reference to FIGS. 3-5, the work platform 10 also includes load engaging device compartments 114. The load engaging device compartments 114 are each sized to receive the load engaging device 46 of a respective hoist apparatus 18. Each load engaging device compartment 114 can be utilized to support the load engaging device 46 for reeving and unreeving. Utilization of the compartments provides an unobstructed work surface 54 for maintenance personnel that includes an optimized amount of space.

Figure 2:
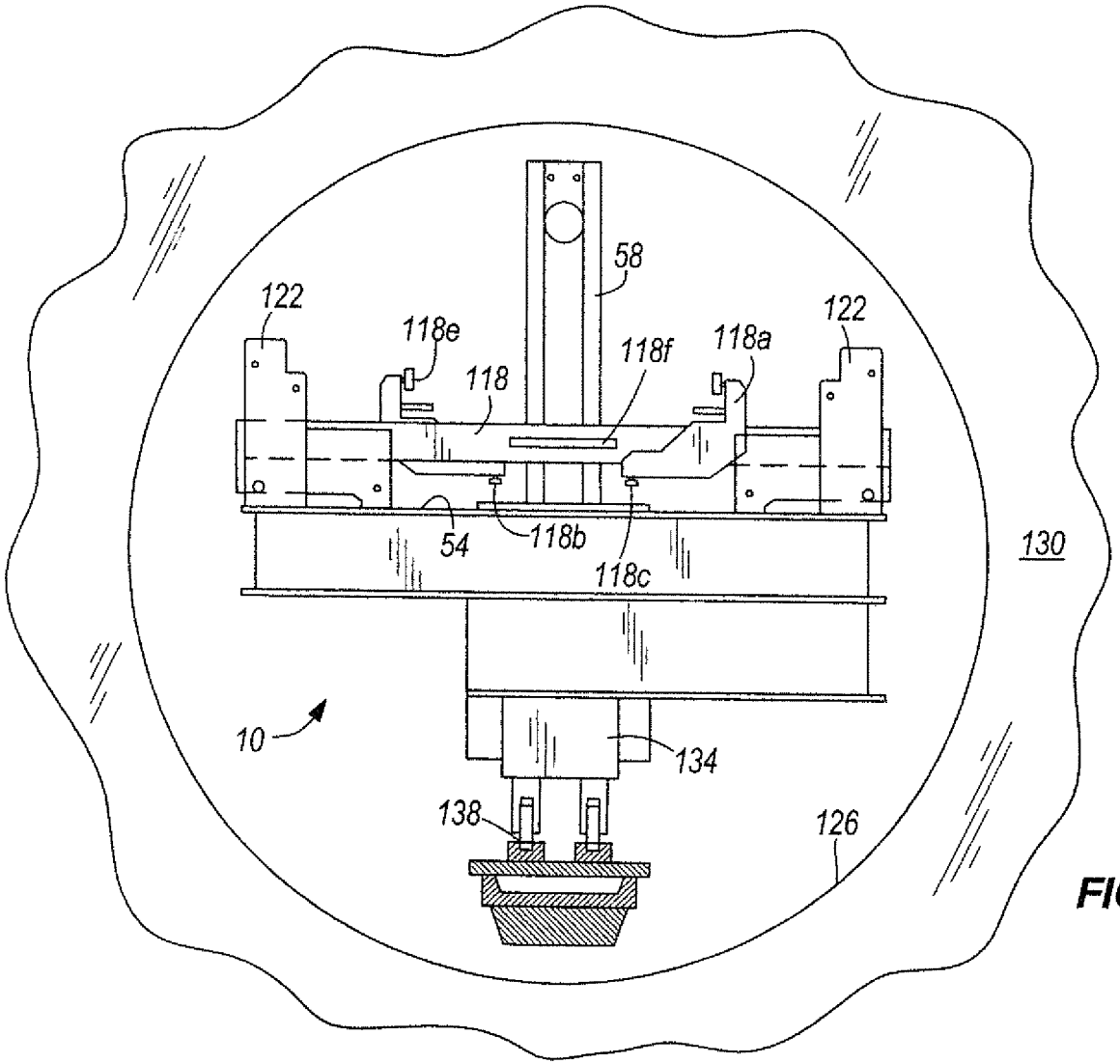
FIG. 2 illustrates an elevation view of the work platform of FIG. 1 moving through an equipment hatch of a containment building.
Figure 6:
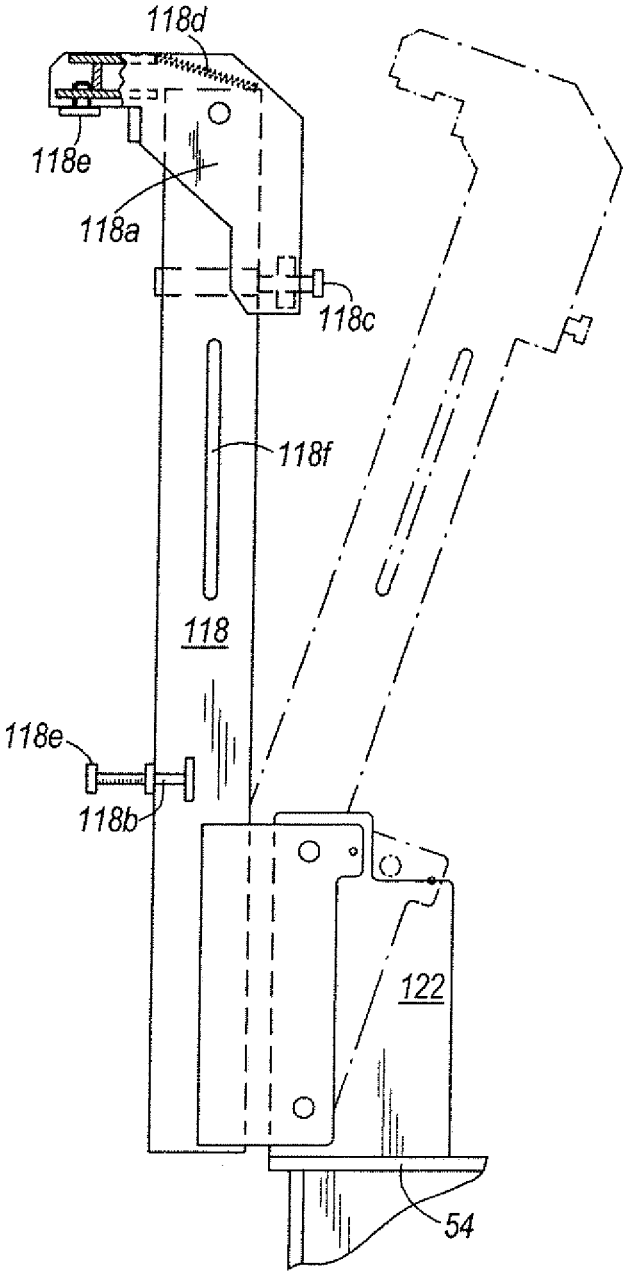
FIG. 6 illustrates a side view of a suspension support of the work platform of FIG. 1.
Figure 7:
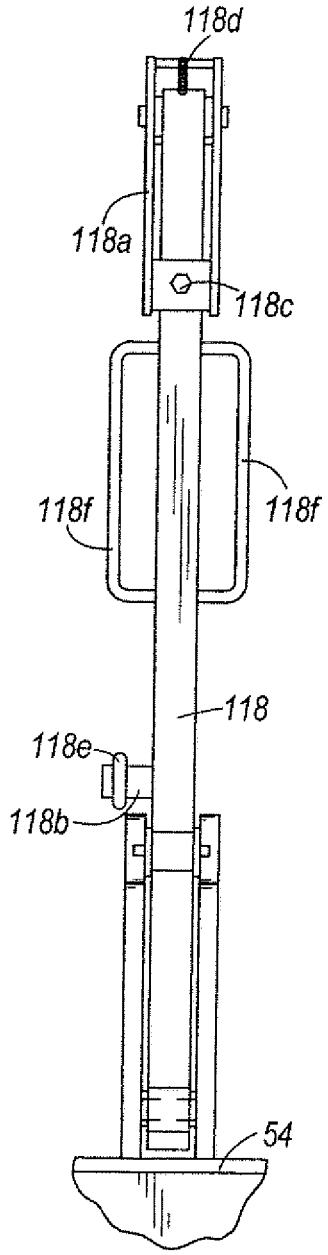
FIG. 7 illustrates a rear view of the suspension support of FIG. 6.

With reference to FIGS. 1 and 6-7, the work platform 10 includes four suspension supports 118. each suspension support 118 is secured to a bracket 122 mounted on the work surface 54 using two pins. Each suspension support 118 is movable between a folded position, as shown in FIG. 2 and as shown in dotted lines in FIG. 5, a hoisting position, as shown in FIG. 3 and as shown in doted lines in FIG. 6, and a maintenance performing position, as shown in solid lines in FIGS. 1 and 4-8. A top portion 118*a* of each suspension support 1189 includes a pivotable head having a profile that allow the hoist apparatus 18 to pass over the top (i.e., the suspension supports 118 do not interference with the interaction between the hoist apparatus 18 and the rails 30). each suspension support 118 includes a horizontal stabilizer 118*b*, a vertical stabilizer 118*e*, and a biasing member 118*d*. the vertical stabilizer 118*c* pivots the top portion 118*a* relative to the remainder of the suspension support 118. The biasing member 118*d* includes a spring that biases the top portion 118*a* against the vertical stabilizer 118*c*. Contact pads 118*e* on the top portion 118*a* and the horizontal stabilizer 118*b* may include an elastomer or other non-abrasive material to prevent metal-to-metal contact and paint scraping on the girders 22. As best shown in FIG. 7, each suspension support 118 also includes a set of hand grips 118*f*. In other embodiments, the work platform 10 may include other types of support members that connect the work platform 10 to the girders 22. In one such embodiment, the support member(s) may be mounted on the rails 30 fro movement of the work platform 10 relative to the girders 10. A come-along or other suitable means may be utilized to move the work platform 10 relative to the crane 14.

As best seen in FIG. 3, the work platform 10 has a width corresponding to the distance between the girders 22. That is, the work platform 10 is sized so that the suspension supports 118 are approximately spaced from one another to properly engage the girders 22. As shown in FIG. 10, another embodiment of a work platform 200 according to the present invention includes a base 202 whose width can be changed to accommodate various spacings between girders 222.

The work platform 200 includes a central portion 204 that is connected to suspension supports 218. The central portion 204 may be connected to the suspension supports 218 through a connecting spacer plate 206 that is sized for the particular girder spread the work platform 200 is to be used on. Depending on the size of the spacer plate 206, the suspension supports 218 will be closer to or farther away from the central portion 204 of the work platform 200, thereby changing the overall width of the work platform 200 to correspond to the particular girder spread.

Alternatively, the central portion 204 may be connected to the suspension supports 218 using a hydraulic connection 208, as shown in FIG. 10. Actuation of the hydraulic connection 208 moves the suspension supports 218 and the central portion 204 without the need for custom manufacturing spacer plates 206 for the particular girder spread on which the work platform 200 is to be used.

In some embodiments, the work platform 10 or 200 may include bottom support members such as retractable outrigger supports that extend from the work platform 10 to contact the bottom guide of the girders 22. The bottom support members act as a positive stop when hoisting the work platform 10 to the girders 22. Bottom support members are particularly useful when hoisting a work platform 10 using a single hoist apparatus 18. the hoist apparatus 18 can hoist the work platform 10 until the bottom support members are tight against the underside of the girders 22, thereby providing a stable work surface 54 until the suspension supports 118 are in place.

The work platform 10 is designed as a fluid tight structure to prevent fluids (e.g., water, oil, lubricants, and the like) utilized while performing maintenance from falling through the work platform 10 and to the floor below. the work platform 10 is also designed to prevent objects (e.g., tools, equipment, and the like) utilized while performing maintenance from falling through the work platform 10 and to the floor below. Further, the work platform 10 is designed to utilize removable pins and quick connections for ease of the assembly of removable and/or collapsible components (e.g., handrails 94, suspensions supports 118) of the work platform 10. The pins may include grab handles for ease of removal, and tie chains secured to the work platform 10 to prevent dropping of the pins from the work platform 10. The removable pins may be stowed in a compartment under the work surface 54 when not being used.

The work platform 10 includes electrical service to allow for utilization of power tools and welding equipment. In one construction, power is connected to the work platform 10 by means of a cable reel, tag line festoon, or the like. A circuit breaker may be located on the work platform 10 that includes control of all power to the hoist unit 74 and the receptacles located on the work platform 10.

The work platform 10 includes a control for the hoist unit 74 that allows the maintenance personnel to raise and lower the mast 58 relative to the work surface 54. In one construction, the hoist unit control includes an isolation transformer and is located in a compartment under the work surface 54 near the mast 58. A mast control pushbutton station 123 (schematically illustrated in FIG. 4), with mast on/off and mast raise/lower controls, is electronically connected to the hoist unit control. The mast control pushbutton station 123 may include a cord or wireless connection that allows for operation of the mast 58 from any location on the work surface 54. The mast control pushbutton station 123 may also include attachment controls (e.g., jib crane attachment controls, drum cradle attachment controls, worker basket attachment controls). In other constructions, the attachments may be alternatively controlled.

The work platform 10 also includes a crane control pushbutton station 124 (schematically illustrated in FIG. 4) that allows for remote operation of the crane 14. The crane control pushbutton station 124 is electrically connected to the crane controls. The crane control pushbutton station 124 includes crane on/off, hoist-one raise/lower and forward/reverse, hoist-two raise/lower and forward/reverse, and girders forward/reverse controls. The crane pushbutton station 124 may include a cord or wireless connection that allows for operation of the crane 14 from any location on the work surface 54. In one embodiment, the normal crane controls are locked-out to only allow operation of the crane 14 using the crane control pushbutton station 124 while the work platform 10 is being utilized to perform maintenance. Pendant controls 224, as shown in FIG. 10, may also be utilized, providing a worker with wired control of the work platform 200 from a remote location, such as the ground, a girder 222, etc.

With reference to FIG. 2, the work platform 10 is designed to fit through an equipment hatch 126 of a containment building 130. The illustrated work platform 10 is approximately twelve feet wide, twenty four feet long, four feet deep and weighs approximately twenty-one tons. The equipment hatch 126 is approximately fourteen feet, six inches in diameter. the work platform is brought into the containment building 130 in a collapsed state on an equipment hatch transfer car 134. the transfer car 134 is supported on a pair of temporary rails 138 that extend into the containment building 130.

When the work platform 10 is inside the containment building 130, the removable and/or collapsible components (e.g., handrails 94, suspension supports 118) of the work platform 10 are assembled to configure the work platform 10 in an uncollapsed state. Configuration of the work platform 10 in the uncollapsed state may occur before and/or after the work platform is connected to the girders 22.

In the illustrated embodiment, a respective hoist apparatus 18 (e.g., an auxiliary hoist apparatus of the crane 14) is utilized to lift the suspension supports 118 from the folded position to the hoisting position. The illustrated suspension supports 118 weigh approximately 400 pounds. the suspension supports 118 may be locked in the hoisting position using the pins. As illustrated in FIG. 6, the hoisting position is approximately eighty percent of the maintenance performing position. Placement of the suspension supports 118 in the hoisting position allows a maintenance personnel to move the suspension supports 118 the remainder of the way to the maintenance performing position using the hand grips 118*f*. the suspension supports 118 are moved to the maintenance performing position when the work platform 10 is positioned in a hoisted position, as illustrated in FIG. 3.

According to the work platform 200, as shown in FIG. 10, the suspension supports 218 move into position hydraulically (i.e., they hydraulically move from folded positions, to their hoisting positions, to their maintenance performing positions), eliminating the need to use the hoist apparatus 18 and/or manual assistance to move the suspension supports 218 into position. Shoes 210 may or may not be manually adjusted for the particular girder angle and girder geometry. Further, the suspension supports 218 are constructed to include first portions 214 that move within second portions 216 so that the height of the base portion 202 of the work platform 200 can be adjusted relative to the girders 222. The base portion 202 of the work platform 200 is coupled to the second portions 216 of the suspension supports 218. therefore, the base portion 202 moves up and down when the first portions 214 move within the second portions 216 of the supports 218.

Figure 12:
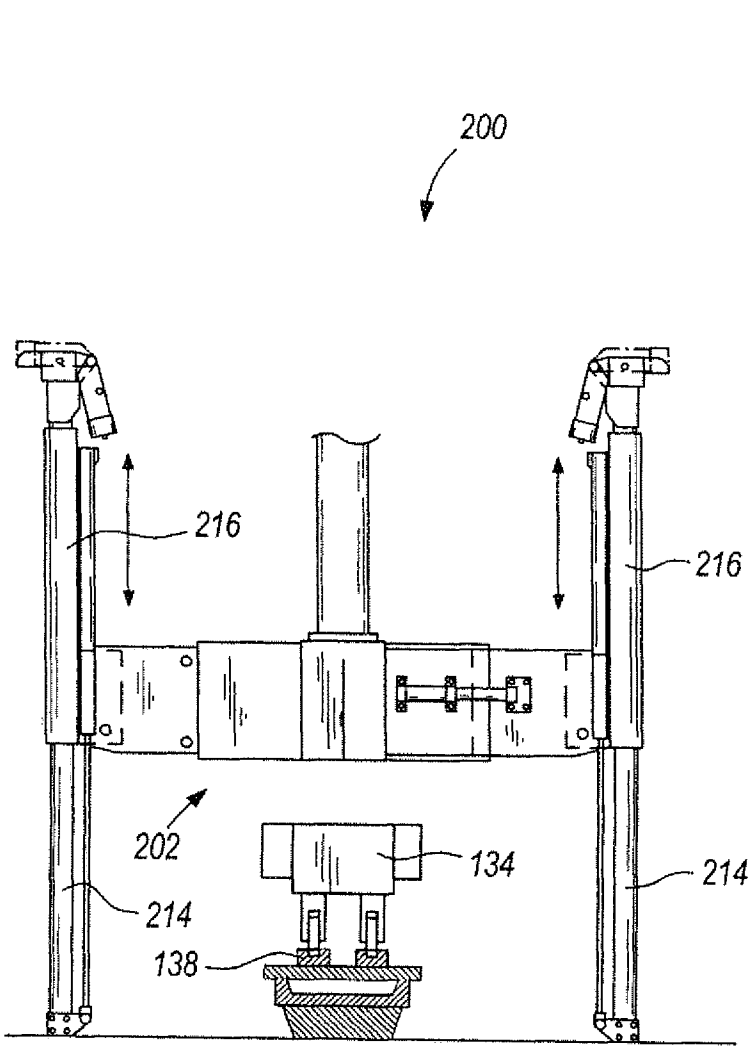
FIG. 12 illustrates the work platform of FIG. 10 lifted off of transfer car of FIG. 11 and standing on support members above the transfer car.
Figure 11:
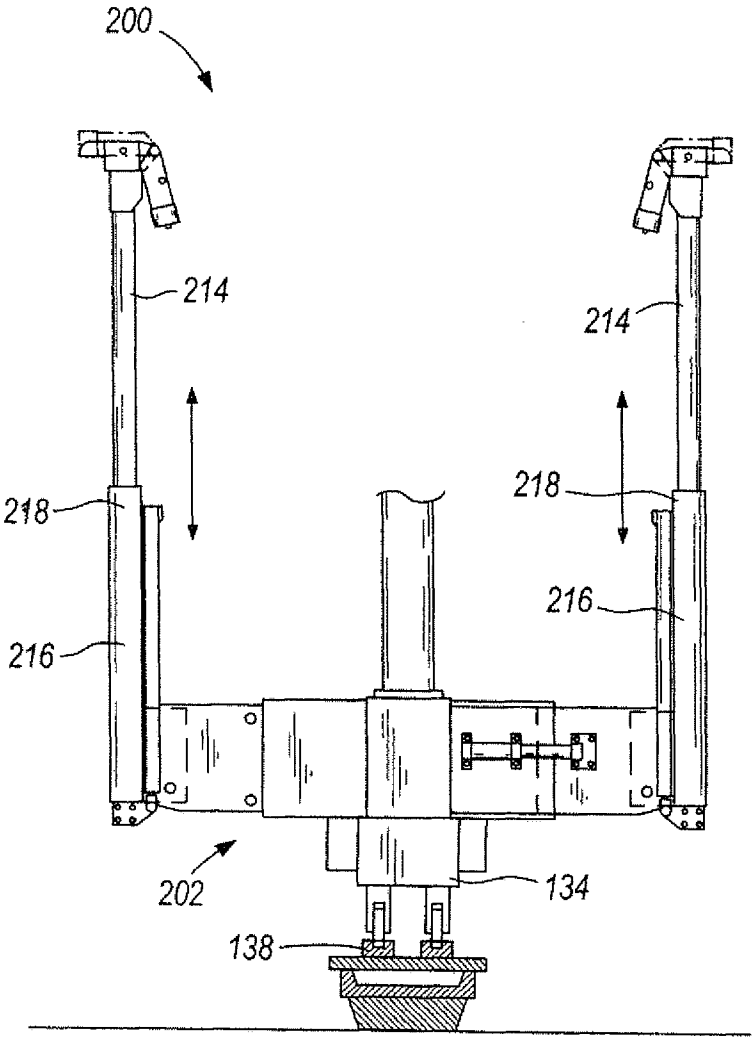
FIG. 11 illustrates the work platform of FIG. 10 on an equipment hatch transfer car.

As shown in FIGS. 11 and 12, the movement of the first portions 214 through the second portions 216 of the suspension supports 218 can be utilized to lift the work platform 200 off of the equipment hatch transfer car 134 that may be used to move the work platform 200 into a containment building. When the work platform 200 is positioned within the building and it is desired to move the equipment hatch car out from below the work platform 200, the base portion 202 of the work platform 200 can be lifted off the equipment hatch transfer car by moving the first portions 214 of the suspension supports 218 through the second portions 216 until the first portions 214 engage the ground beneath the equipment hatch transfer car. Once the first portions 214 have engaged the ground, further movement of the first portions 214 through the second portions 216 will cause the base portion 202 of the work platform 200 to raise off of the equipment hatch transfer car 134, as shown in FIG. 12. The equipment hatch transfer car 134 can then be moved on rails 138 out from under the base portion 202 of the work platform 200 while the base portion 202 is "standing" above the equipment hatch transfer car 134 on the first portions 214 of the suspension supports 218, as shown in FIG. 12.

Figure 13:
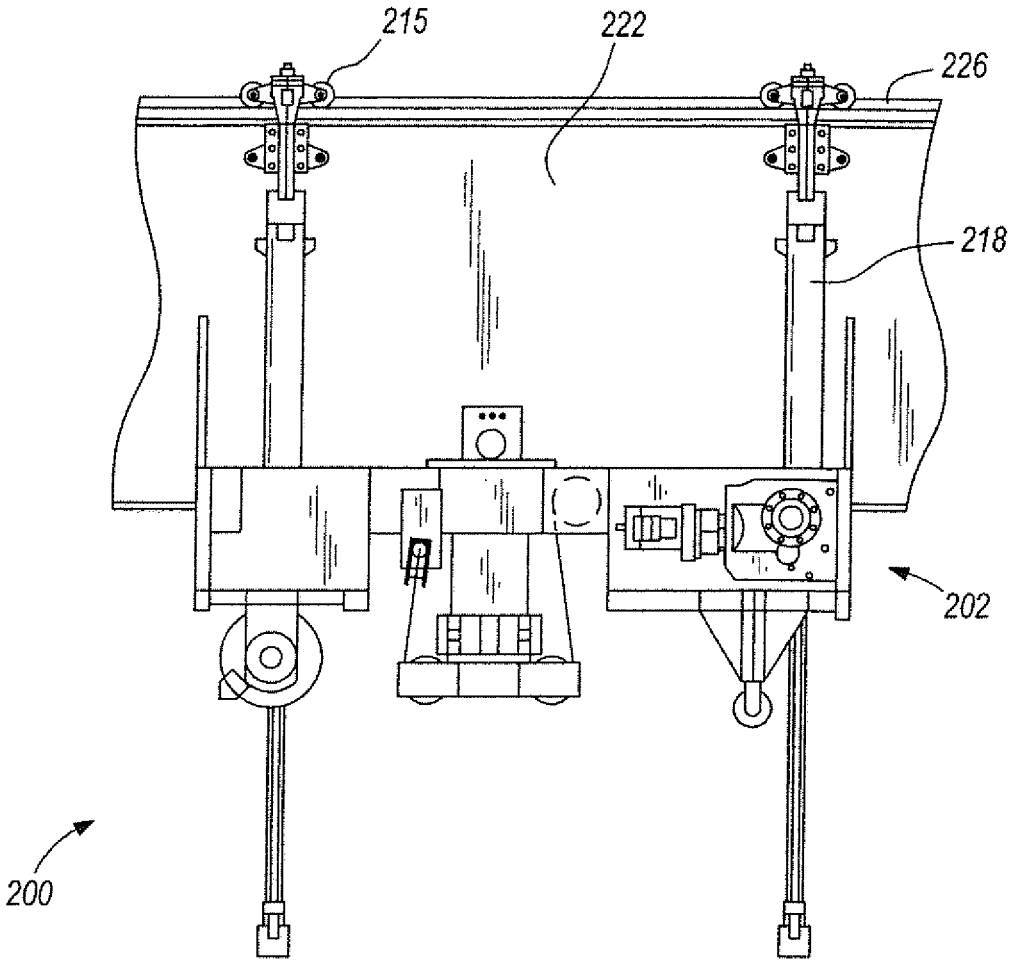
FIG. 13 illustrates a side view of the work platform of FIG. 10.
Figure 14:
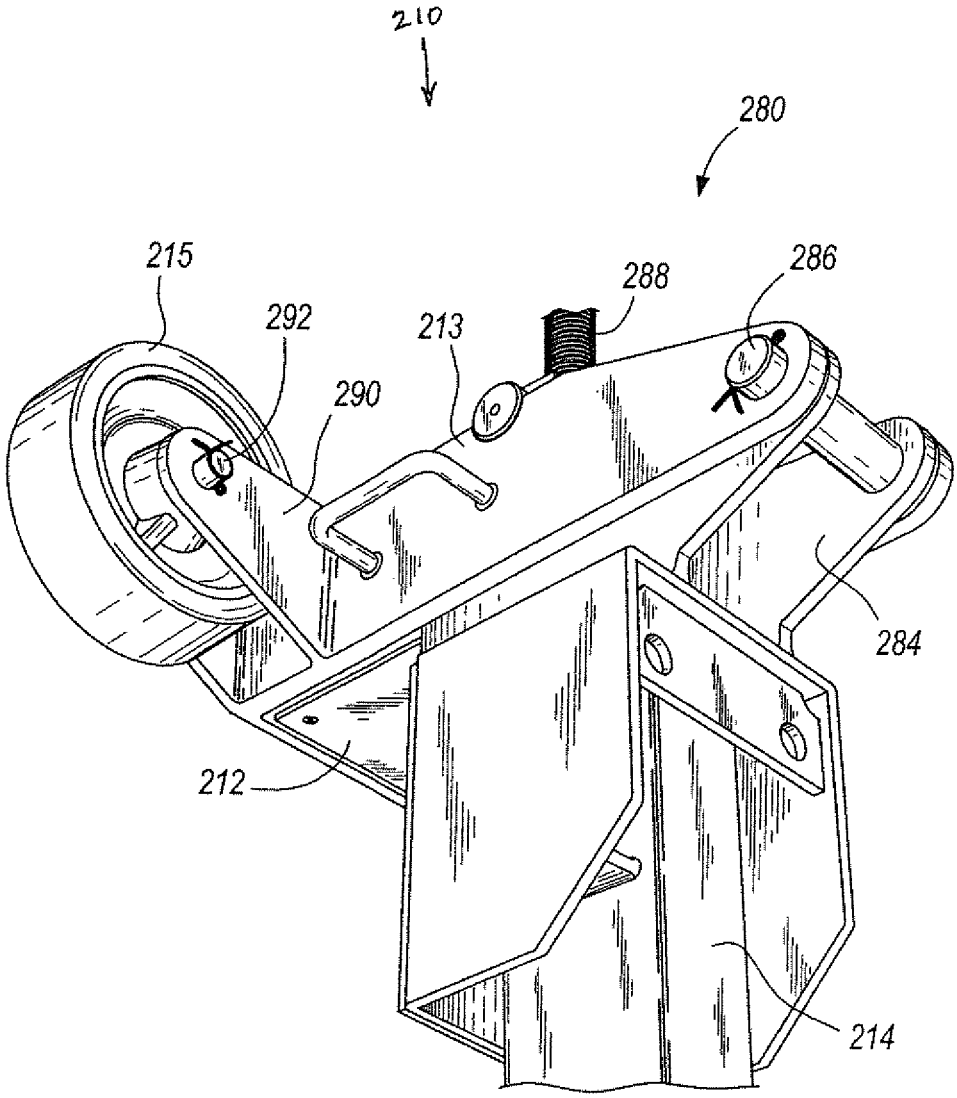
FIG. 14 illustrates a perspective view of a portion of the work platform of FIG. 10.

In addition to the base 202 of the work platform 202 being movable generally vertically relative to the girders 222 by movement of the first portions 214 of the suspension supports 218 relative to the second portions 216, the entire work platform 200 may be moved laterally along the girders 222. Referring particularly to FIGS. 10, 13 and 14, the shoes 210 of the suspension supports 218 include a wheel attachment 280 (FIG. 14) having a first portion 212 and a second portion 213. The first portion 212 include a support 284 and the second portion 213 is pivotally coupled to the support 284 by a pin 286. The second portion 213 is movable between a disengaged position (illustrated in FIGS. 10-12) and an engaged position (illustrated in FIGS. 13 and 14). A ball screw assembly 288 is coupled to the first portion 212 and engages the second portion 213 when the second portion 213 is in the engaged position. A wheel 215 is coupled to a projection 290 of the second portion 213 for rotation about a pin 292.

When it is desired to hold the work platform 200 fixed with respect to the girders 222, the first portions 212 are engaged with the upper surface of the girders 222 in a manner similar to that discussed above with respect to the suspension supports 218, and the second portions 213 are rotated to the disengaged positions as illustrated in FIGS. 10-12. However, if it is desired to move the work platform 200 laterally along the girders 222, the second portions 213 of the shoes 210 are rotated about the pin 286 so that the wheels 215 engage the respective upper surfaces of the girders 222. With the wheels 215 engaging the girders 222, the second portion 213 is pulled closer to leg 214 by rotation of the ball screw assembly 288. Rotation of the ball screw assembly 288 lifts the first portion 212 off of the girders 222 such that the work platform 200 is supported by the wheel 215. When each of the wheels 215 are resting on the upper surfaces of the girders 222, the work platform 200 is free to roll along the upper surfaces of the girders 22 on the wheels 215.

Some or all of the wheels 215 can be driven for automatic movement of the work platform 200 along the girders 222. Alternatively, the wheels can simply be mounted for free rotation requiring external force (e.g., a manual force) to move the work platform 200 along the girders 222. similarly, the balls crew assemblies 288 may be driven for automatic lifting of the first portion 212 from the girders 222, or the ball screw assemblies 288 may be adjusted manually.

Referring back to FIGS. 1 through 8, when the work platform 10 is ready to be hoisted, the load engaging devices 46 of the hoist apparatus 18 are lowered and connected to the hook linkages 106. When each load engaging device 46 is securely connected, the motors 50 are driven to turn the drums 38 in the wind-on direction. The work platform is hoisted up to the girders 22 (i.e., to the hoisted position). Hoisting the work platform 10 for placement on the crane 14 using the crane 14 eliminates the need for other lifting equipment. In other constructions, the work platform 10 my be hoisted to the girders 22 using fewer or more hoist apparatus 18.

While the work platform 10 is still supported by the hoist apparatus 18, the suspension supports 118 are connected to the girders 22 (i.e., moved to the maintenance performing position). The horizontal stabilizers 118*b* are adjusted to center the work surface 54 between the girders 22. the vertical stabilizers 118*c* are adjusted to level the work surface 54. The suspension supports 118 may be utilized to fully support the work platform 10. In other embodiments, the load engaging devices 46 may remain connected to the hook linkages 106 to provide additional support. Once the work platform 10 is stabilized, the wing plates 98 are pivoted in position against the girders 22 (FIG. 3-5) to prevent objects from falling between the work platform 10 and the girders 22.

When the work platform 10 is in the maintenance performing position, as illustrated in FIG. 4, the maintenance personnel can begin to perform the necessary maintenance.

In one embodiment, maintenance may include the replacement of the hoist drum assembly 64. The drum cradle attachment 62 is connected to the mast 58 and moved into position under the hoist drum assembly 64. The crane control pushbutton station may be utilized to position the hoist apparatus 18 above the mast 58. Further, the longitudinal adjustment feature of the drum cradle attachment 62 may be utilized to position the drum cradle attachment 62 directly below hoist drum assembly 64. The mast 58 is then raised vertically and the hoist drum assembly 64 is lifted from its bearing seats. When the hoist drum assembly 64 is clear of the remaining components of the hoist apparatus 18, the crane control pushbutton station 124 is utilized to move the remaining components of the hoist apparatus 18. The drum cradle attachment 62 is then rotated ninety degrees so the drum axis is parallel to the girders 22. The mast 58 is lowered to bring the drum cradle attachment 62 near the wok surface 54. The hoist drum assembly 64 can then be lowered off the work platform 10 using an existing hoist apparatus 18 or, alternatively, a listing device(s) that is temporarily supported by the crane 14 or structure adjacent to the crane 14.

The work platform 10 provides a convenient means to work high in the air, while virtually eliminating the possibilities of objects and/or fluids falling to the ground. The work platform 10 includes the ability to lift heavy pieces on to and off of the crane 14. The work platform 10 also allows for the operation of power tools and welding equipment. Additionally, the crane 14 can be remotely operated from the work platform 10, and the work platform 10 does not interfere with operation of the crane 14.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A method of implementing a work platform for an overhead crane, the overhead crane including a support structure that supports a hoist above the ground and the work platform including a base and a first support member, the first support member including a vertically extending first portion that has a shoe secured at its upper end, wherein the first portion vertically moves within a second portion coupled to the base so that the base moves up and down relative to the first portion of the first support member when the first portion of the support member vertically moves within the second portion of the first support member, the method comprising the steps of:

moving the work platform on a car into a space serviced by the overhead crane;

engaging a lower end of the first portion of the first support member with the ground about the car by downwardly moving the first portion of the first support member within the second member of the first support member;

lifting the work platform off of the car by further downwardly moving the first portion of the first support member within the second member of the first support member; and after the work platform is lifted off the car, moving the first support member to engage the shoe with the support structure to support the work platform on the support structure.

2. The method according to claim 1, further comprising the step of moving the car out from under the work platform.

3. The method according to claim 1, wherein a second support member is engaged with the ground around the car along with the first support member and moving the base of the work platform along the second support member, as well as along the first support member, to lift the work platform off of the car.

4. The method according to claim 3, wherein third and fourth support members are engaged with the ground around the car along with the first and second support members and moving the base of the work platform along the third and fourth support members, as well as along the first and second support members, to lift the work platform off of the car.

5. The method according to claim 1, further comprising the step of moving the first portion of the first support member up and down within the second member of the first support member to move the base up and down relative to the support structure while the work platform is supported on the support structure.

* * * * *